US006006367A

United States Patent [19]

Webster

[11] Patent Number: 6,006,367

[45] Date of Patent: Dec. 28, 1999

[54] SWIMMING GOGGLES

[76] Inventor: Colin Wesley Webster, 25 Morrow Avenue, Toronto, Ontario, Canada, M6R 2H9

[21] Appl. No.: 09/026,210

[22] Filed: Feb. 19, 1998

[51] Int. Cl.[6] ..... A61F 9/02

[52] U.S. Cl. ..... 2/430; 2/447

[58] Field of Search ..... 2/428, 430, 432, 2/440, 447, 445, 431; 351/43, 59

[56] References Cited

U.S. PATENT DOCUMENTS

| | | | |
|---|---|---|---|
| 2,909,959 | 10/1959 | Girden | 88/1 |
| 3,019,689 | 2/1962 | Paulsrud | 88/1 |
| 3,058,392 | 10/1962 | Primeau | 88/41 |
| 3,725,953 | 4/1973 | Johnson et al. | 2/428 |
| 4,279,039 | 7/1981 | Drew | 2/428 |
| 4,375,316 | 3/1983 | LeVantine | 350/302 |
| 4,468,819 | 9/1984 | Ohno | 2/430 |
| 4,647,165 | 3/1987 | Lewis | 351/59 |
| 4,679,916 | 7/1987 | Roller et al. | 350/623 |
| 4,755,023 | 7/1988 | Evans et al. | 2/424 X |
| 5,148,327 | 9/1992 | Gaxiola, Jr. | 359/855 |
| 5,216,454 | 6/1993 | Berke | 2/430 X |
| 5,345,615 | 9/1994 | Garofalo | 2/430 |
| 5,457,502 | 10/1995 | Iida | 2/447 X |

FOREIGN PATENT DOCUMENTS

| | | | |
|---|---|---|---|
| 893643 | 2/1944 | France | 2/428 |
| 2430-625 | 7/1978 | France . | |

*Primary Examiner*—Peter Nerbun
*Attorney, Agent, or Firm*—Young & Basile, P.C.

[57] ABSTRACT

Swimming goggles comprising first and second frame sections each having a peripheral flange adapted to effect a water tight seal with the face of a wearer, two transparent face plates and two transparent top members located above the face plates. The two frame sections are flexibly connected to one another. Both the face plates and the top members are sealingly secured in the frame sections. Each face plate is adapted to cover an eye of the wearer. The face plates extend in a plane substantially perpendicular to a normal line of vision. The top members each have planar top and bottom surfaces with each of the top surfaces extending at a substantial angle not exceeding 90 degrees to the plane of the face plates. The top members act to refract incoming light striking the top surfaces thereof. The wearer is thus able to see horizontally an object in front of the wearer while he is swimming with his head facing downwardly. An anti-reflection coating can cover the bottom surface of each top member.

12 Claims, 3 Drawing Sheets

SWIMMING GOGGLES

BACKGROUND OF THE INVENTION

This invention relates to swim goggles and masks for swimmers.

The use of face masks for swimmers and smaller swimming goggles is well known, such products having been used for some time. A face mask designed to cover the eyes and nose of a swimmer has a transparent viewing portion which may take the form of a single window. A flexible flange, which may be made of rubber or rubber-like material can form a frame portion around the window and acts to provide a water tight seal between the face mask and the face of the swimmer. Thus, water is excluded from the space between the swimmer's eyes and the transparent viewing portion.

In the case of goggles designed only to cover the eyes, there can be a pair of small face plates or lenses, each mounted in a flexible flange forming a surrounding frame. A flexible strap can be used to attach the goggles or the face mask to the swimmer's head.

Although it is often desirable when swimming, particularly when using certain strokes such as the crawl, to arrange one's body in a horizontal or prone position with one's face immersed in water, this will result in the swimmer's line of vision being directed downwardly. As a result, it can be difficult for the swimmer to maintain a desired course and to properly see approaching objects or other swimmers and this situation may even result in some danger to the swimmer. For example, when a swimmer in a pool has his face directed downwardly, he or she may not see the wall of the pool as he or she approaches it. This can be a particularly serious problem if the swimmer is involved a race and is seeking to achieve maximum speed through the water.

U.S. Pat. No. 2,909,959 which issued Oct. 27, 1959 to B. B. Girden describes a special swimming face mask equipped with a periscope. This device enables a swimmer to not only direct his view downwardly through the face plate of the mask for observing underwater activity but also, without shifting his head, to conveniently view the scene above the surface of the water through the periscope. However, this known device would be reasonably expensive to construct and it is only designed to view scenes above the surface of the water in addition to the view seen along the normal line of vision through the face mask. It is not designed to permit the swimmer to view the underwater scene ahead of him in the direction of swimming motion while his head is facing downwardly in the water. Also, it is believed that this known device would not be particularly suitable for swimmers involved in a race, for example, as it would interfere too much with the swimming motion of the swimmer and would tend to slow down the swimming motion of the swimmer.

Accordingly, it is an object of this invention to provide goggles for swimming that will permit a swimmer not only to view a scene along his normal line of vision, whether the swimmer is in the water or not, but will also permit the swimmer to view an object or objects horizontally in front of him or her while the swimmer is swimming with his head facing generally downwardly in the water.

It is a further object of the present invention to provide an improved set of goggles or an improved face mask for swimming which can be made at a reasonable cost competitive with other goggles and face masks but which permits the wearer not only to view a scene along his or her normal line of vision but also horizontally in front of the swimmer while he or she is swimming and has his or her head facing downwardly.

SUMMARY OF THE INVENTION

According to one aspect of the invention, goggles for swimming comprise a frame portion including resilient flanges dimensioned to affect a water tight seal with the face of a wearer and at least one transparent face plate sealingly secured in the frame portion in order to cover the eyes of the wearer. The face plate extends in a first plane substantially perpendicular to a normal line of vision of the wearer. There is also at least one transparent top member secured in the frame portion above the face plate. This top member has a planar top surface extending at a substantial acute angle ranging substantially between 20 and 90 degrees to the first plane. The wearer of the goggles is able to see horizontally an object in front of the wearer while the wearer is swimming with his or her head facing generally downwardly in the water.

Preferably, the goggles include a strap which is connected at opposite ends thereof to the frame portion, this strap being usable for securing the goggles to the wearer's head.

According to another aspect of the invention, goggles for swimming comprise first and second frame sections each having a peripheral flange adapted to affect a water tight seal with the face of a wearer and two transparent face plates each sealingly secured in a respective one of the frame sections and adapted to cover an eye of the wearer. The two frame sections are flexibly connected to one another. The face plates extend in a plane substantially perpendicular to a normal line of vision of the wearer. Two transparent top members are each sealingly secured in respective one of the frame sections and have planar top and bottom surfaces. Each of the top surfaces extends at a substantial angle not exceeding 90 degrees to the plane of the face plates. Due to refraction of light passing through the top members, the wearer of the goggles is able to see horizontally an object in front of the wearer while the wearer is swimming with his or her head facing generally downwardly in the water.

Preferably a nose bridge flexibly connects the first and second frame sections together and an anti-reflection coating covers the bottom surface of each top member.

Further features and advantages of the invention will be apparent from the following detailed description of an illustrated preferred embodiment read in conjunction with the accompanying drawings.

DETAILED DESCRIPTION OF PREFERRED EMBODIMENTS

Figure 1:
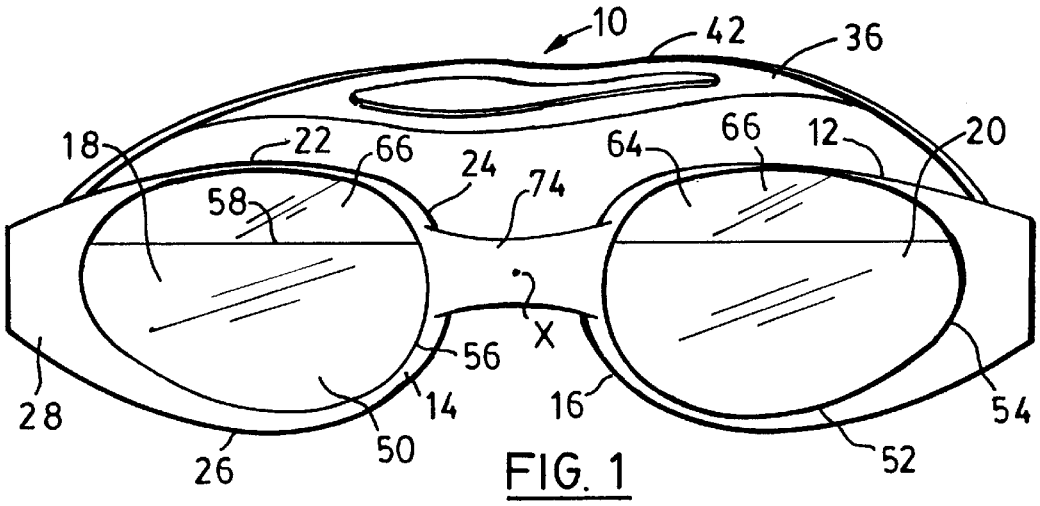
FIG. 1 is a front view of swimming goggles constructed in accordance with the invention.

Goggles 10 for swimming are shown in FIGS. 1 to 4 and these goggles are constructed in accordance with the invention. The goggles or mask have a frame portion 12 that includes resilient flanges 14, 16 dimensioned to effect a water-tight seal with the face of a wearer in order to keep water away from his or her eyes. The resilient flanges can be made of a rubber or rubber-like material or a suitable plastic. Each of the flanges 14, 16 surround a transparent portion 18, 20 of the goggles. These two transparent portions permit the user to see directly in front of him along a normal line of vision. In the illustrated preferred goggles, each of the flanges 14, 16 extends about the perimeter of its respective transparent portion, thus forming an upper flange section 22, an inner flange section 24, a bottom flange section 26 and an outer flange section 28. If desired, the inner edge of each flange 14, 16 can be formed by a foam layer strip indicated at 30 and 32. This strip, which is made of a softer material, provides for a more comfortable fit between the goggles and the face of the wearer and can help provide a better water-tight seal. Also, the flange 14, 16 is deeper along each outer section 28 in order to fit the curvature of the user's face and to adequately cover each eye. Also, each flange section 28 can be provided with a slot or other form of suitable attachment mechanism for connecting a flexible strap 36. The strap is connected at opposite ends 38, 40 to the frame portion and is usable for securing the goggles to the wearer's head. The illustrated strap has a split central portion 42 and bent-back end sections 44 and 46. The length of the strap 36 is normally made adjustable to fit the head of the wearer.

Turning now to the construction of the two transparent portions 18 and 20, these two portions are of similar construction and therefore only the construction of portion 18 will be described in detail herein. The portion 18 has a transparent face plate 50 sealingly secured in the frame portion 12 and provided to cover an eye of the wearer. Each face plate 50 extends in a plane substantially perpendicular to a normal line of vision of the wearer, this line being indicated by the dot-dash line at V in FIG. 3. In the illustrated preferred version of the goggles, the face plate has a rounded bottom edge at 52, a rounded outer edge at 54 and a rounded inner edge at 56. However, its top edge 58 is straight for reasons which will become clearer hereinafter. The transparent portion 18 can include a curved peripheral wall 60 which is sealingly connected to the face plate along the curved edges 52, 54 and 56. Although the preferred wall 60 is transparent, it can also be made opaque or translucent.

Figure 4:
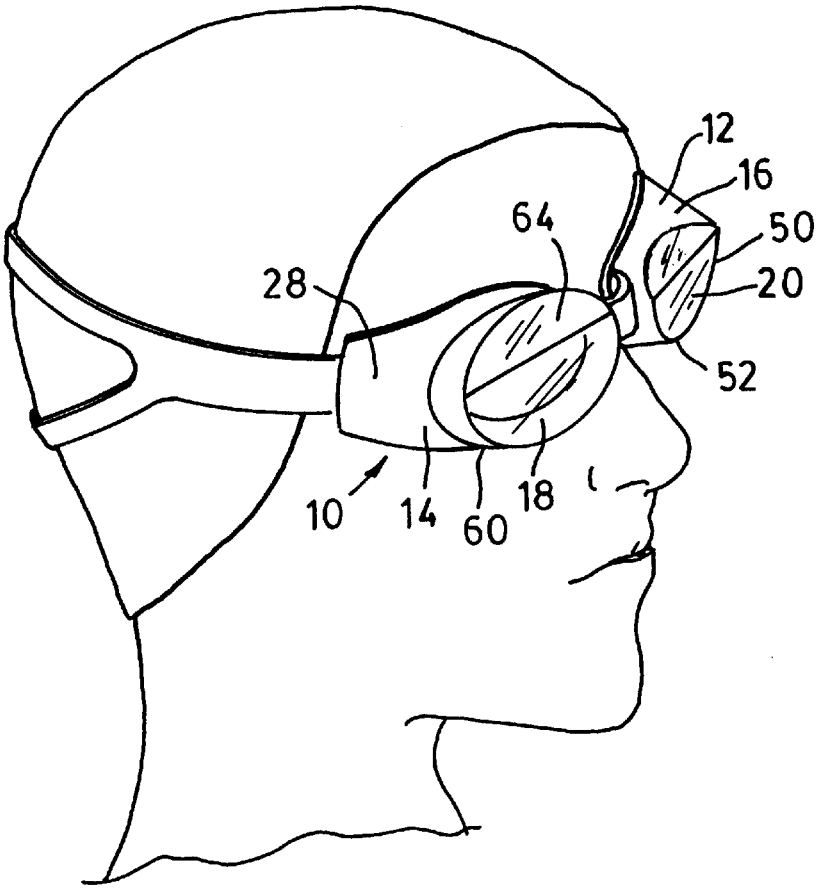
FIG. 4 is a perspective view of a swimmer's head taken from the front and his right side with the swimming goggles extending over his eyes.

Each transparent portion 18, 20 also includes one transparent top member 64 secured in the frame portion above the face plate. This top member has a planar top surface 66 extending at a substantial acute angle ranging up to 90 degrees, ie., perpendicular, to a first plane in which the face plate 50 lies. Preferably, this acute angle indicated at A in FIGS. 5 and 6 lies in a range substantially between 20 and 90 degrees. In the flat plate version of FIG. 5, the preferred range for the angle A is between 70 degrees and 90 degrees (max.). In the prism member version of FIG. 6 described in detail below, the minimum angle A is about 20 degrees. Because of the two transparent top members 64, the wearer of the goggles is able to see horizontally an object or person in front of the wearer while he or she is swimming with his or her head facing generally downwardly in the water as illustrated in FIG. 4.

Figure 2:
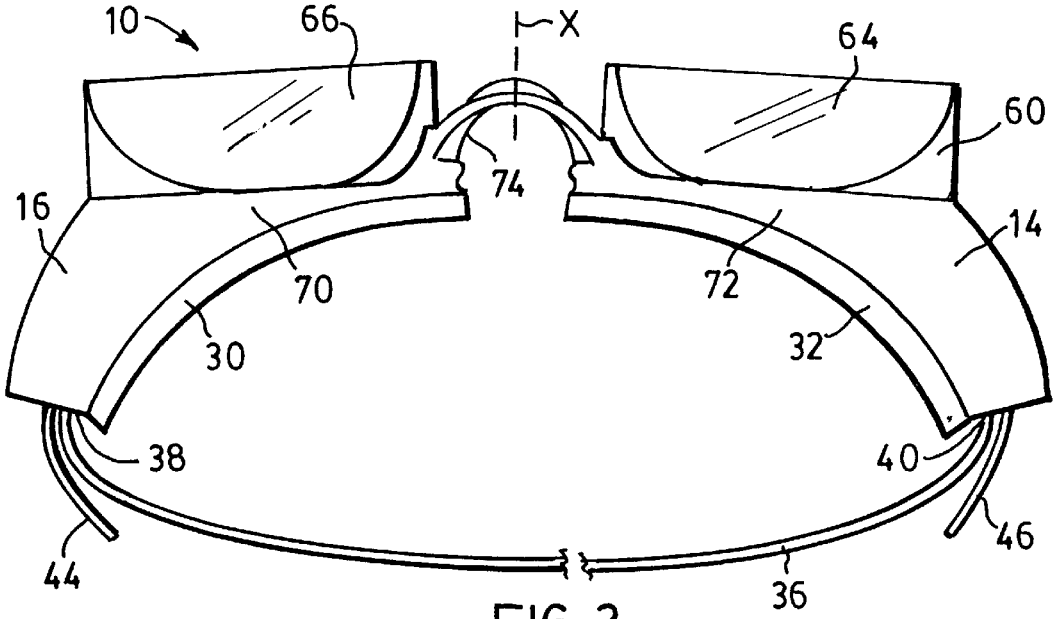
FIG. 2 is a top view of the goggles of FIG. 1 with only end portions of a flexible strap being shown for sake of illustration.
Figure 3:
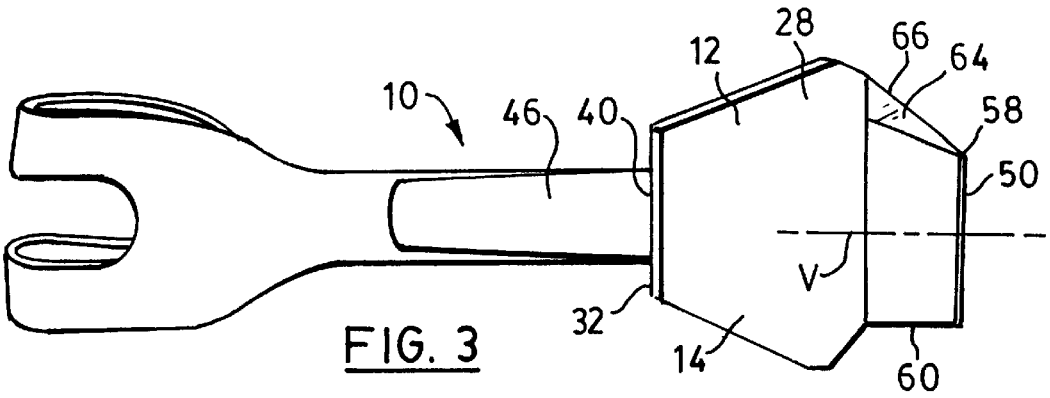
FIG. 3 is a side elevation of the goggles of FIG. 1.

The illustrated preferred goggles or mask have a frame portion that includes two frame sections 70 and 72, one section for each eye. A bridge section 74 adapted to extend over the wearer's nose connects these two frame sections together. Although the preferred bridge section has some flexibility in order to permit the goggles to properly fit the user's face, the preferred bridge section is substantially rigid about a central axis X extending through the center of the bridge section and substantially perpendicular to the plane of the face plates. This axis X is indicated in FIGS. 1 and 2. The reason for this rigidity about the axis X is to maintain the top planar surfaces 66 of the top members in the same plane, thereby permitting a clearer and better image viewable through the top members, as explained further hereinafter. However, the preferred bridge section 74 does permit bending about a generally vertical axis extending through the center of the bridge section. The bridge section can be made of a suitably flexible plastic material or a bendable metal material. The bridge section can either be bonded to the flanges 14, 16 or it can be integrally formed therewith.

Figure 5:
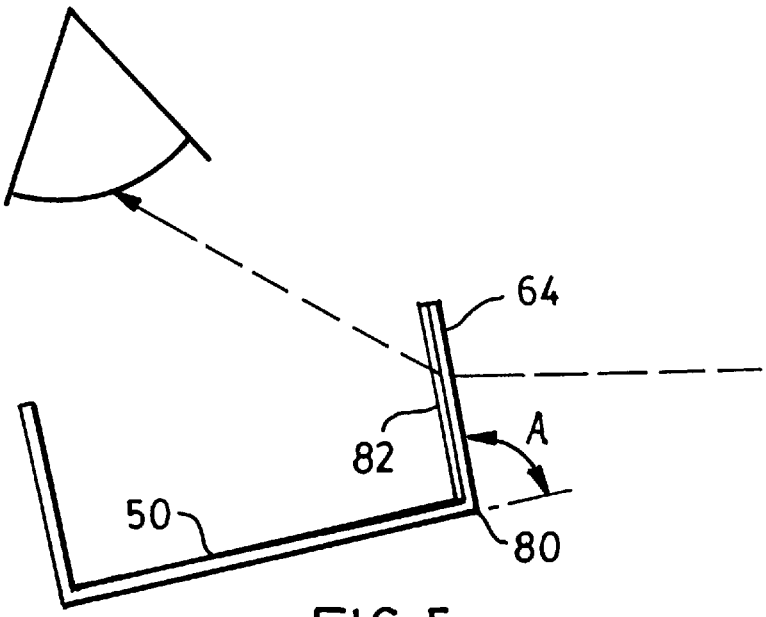
FIG. 5 is a cross-sectional detail view of the transparent portion only of the goggles showing the top of the goggles on the right side and the face plate arranged at a small angle to a horizontal plane.

Returning to the two top members 64, in one embodiment of the goggles, as shown in FIG. 5, each top member is a thin, flat plate having a forward edge 80 rigidly connected to a top edge of the respective face plate. In the embodiment shown in FIG. 5, the thin plate forming top member 64 extends at a 90 degrees angle to the face plate 50 but the angle A can range between a minimum of 70 degrees and 90 degrees. Preferably an anti-reflection coating 82 covers an inner, bottom surface of the top member. Such anti-reflection coatings are well known in the field of optics and a detailed description thereof is therefore deemed unnecessary. The purpose of this coating is simply to prevent the user of the goggles from seeing any reflected image when looking up through the top member. In this version of the goggles, and in the version illustrate in FIG. 6, the inner bottom surface of the top member 64 is planar as well in order not to distort the image viewed through this top member.

Figure 6:
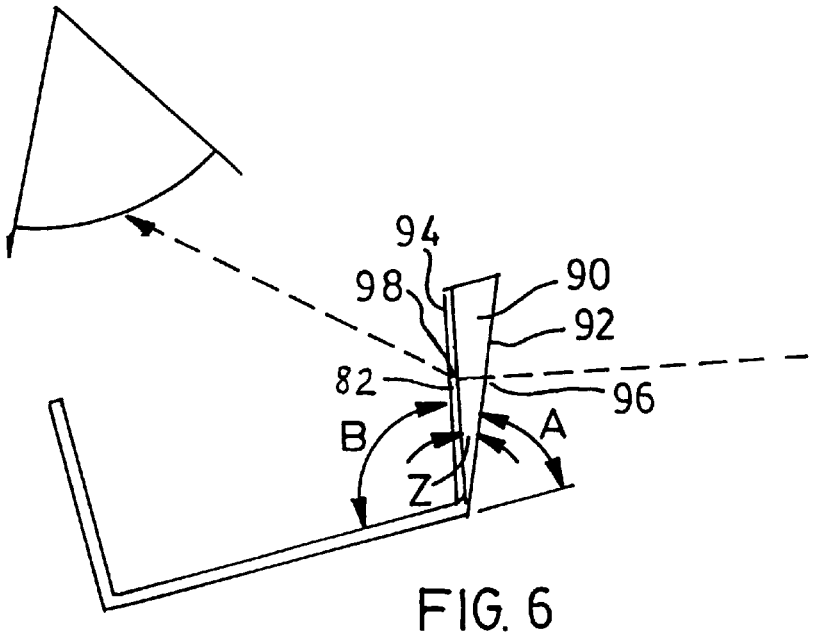
FIG. 6 is a cross-sectional detail view similar to FIG. 5 but showing an alternative embodiment where the top member is a transparent prism.

FIG. 6 illustrates a second, preferred version of the transparent portion of the goggles. In this preferred version, the two top members are refracting prism members 90 each having a planar top surface 92 that extends at a small acute angle indicated at Z to a planar bottom surface 94 of the prism member. Preferably the angle Z is within the range of 0 to 30 degrees. Again, the angle A between the top surface 92 and the plane of the face plate 50 is at least 20 degrees or more and does not exceed 90 degrees. The inside angle B between the bottom surface 94 of the prism member and the plane of the face plate should be an angle no less than 90 degrees and can be more. It will be understood that with the use of the prism members 90 rather than flat plates for the top members, the refraction produced by light passing through the top member is significantly greater, the amount of refraction depending upon the size of the angle Z. As in the first embodiment, the planar inner surface of the prism member is preferably covered with an anti-reflection coating 82.

When deciding whether or not to use flat plate member 64 or prism members for the top members and in selecting the size of the angle A, a couple of parameters at least must be considered. By decreasing the angle A from 90 degrees, one increases the viewing area that can be seen by the swimmer. At the same time, decreasing the angle A will decrease the net bend through refraction. Also, by using a prism instead of flat plate members one increases the net bend of the light through refraction and may also improve the aerodynamics of the goggles. In order to obtain goggles having the best characteristics for a particular swimmer, it is generally necessary to achieve a suitable compromise between obtaining maximum viewing area for the swimmer and achieving maximum bend of the light through refraction. The chosen compromise will depend to some extent on a particular user's needs and characteristics.

It will be appreciated that instead of the illustrated goggles 10 having two transparent front plates, one for each eye and two transparent members, it is also possible to construct a mask for swimming wherein a single flat, transparent front plate is provided to cover the eyes and possibly the nose as well of the wearer. Such face masks (without any transparent top member) are already used commonly by swimmers, particularly swimmers who are swimming underwater and who may be using a snorkel or air-breathing devices. In these known face masks, the transparent front plate is mounted in an encircling frame portion dimensioned to effect a water-tight seal with the face of the wearer. In a mask constructed in accordance with the invention, a single transparent top member can be sealingly secured in this frame portion above the front plate, this top member comprising either a thin, flat plate or a suitable refracting prism member having planar top and bottom surfaces. Again, with such a face mask, the wearer is able to see horizontally an object in front of him or her while he or she is swimming with his or her head facing generally downwardly.

Figure 7:
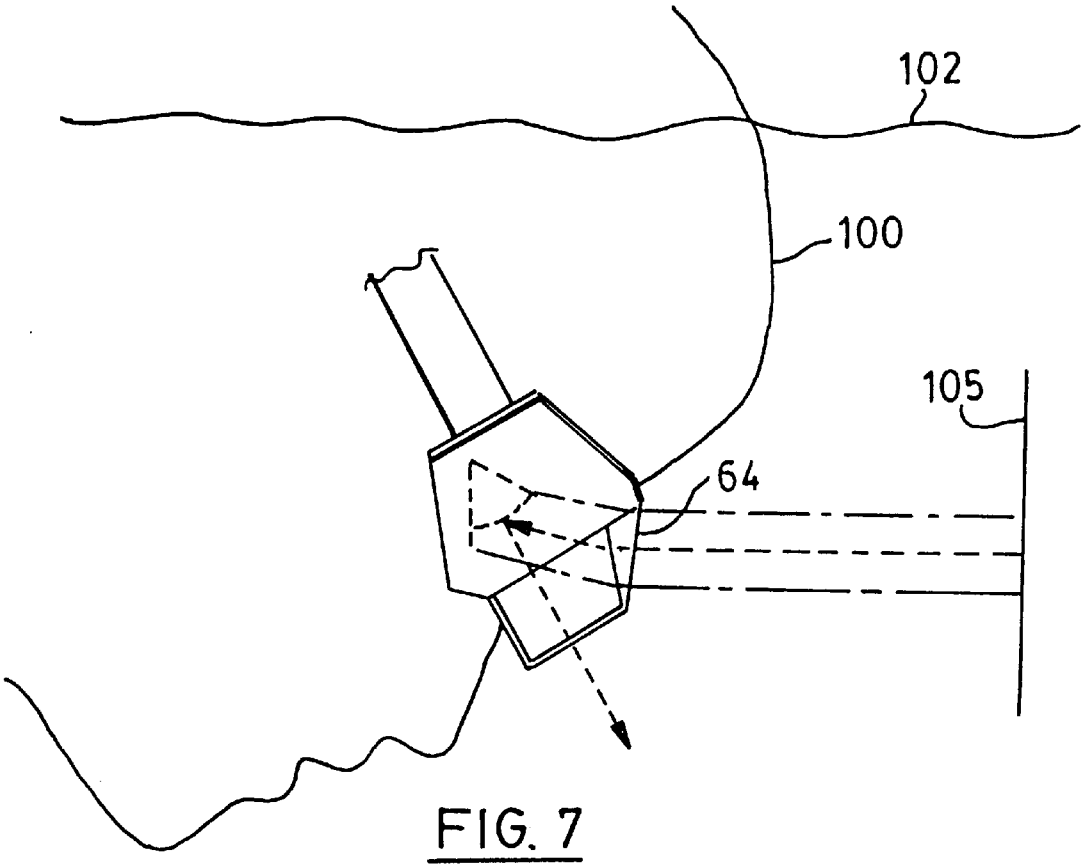
FIG. 7 is a schematic elevational view showing goggles constructed in accordance with the invention secured to a person's head, which is looking downwardly underwater.

FIGS. 5 to 7 illustrate how goggles constructed in accordance with the invention can be used to permit a swimmer to see horizontally an object in front of him or her. In FIG. 7, a head 100 of a swimmer is illustrated and is shown facing downwardly below the surface 102 of a pool or body of water. It will be understood that the illustrated position of the head is the preferred position for certain swim strokes in order to achieve maximum speed. Illustrated schematically on the right side of FIG. 7 is an upcoming wall 105 which can, for example, be the wall of a pool at which the swimmer must either stop or turn. This wall may be located a number of feet in front of the swimmer's head. However, despite the orientation of the swimmer's head, the swimmer is able to see the upcoming wall by looking up through the top members 64 of the goggles. Because of the different densities of water, plastic and air, the light rays are bent as they strike the top and bottom surfaces of the top members 64 with most of the bending occurring along the bottom surface which is the juncture between the relatively dense plastic and the air inside the goggles. This bending effect is shown more clearly in FIGS. 5 and 6. It will be appreciated that the user can see horizontally by simply tilting his head (if necessary) sufficiently to see in this direction through the top members. Even if a slight lifting of the head is required this should not materially affect his or her speed through the water and certainly not to the extent that the speed would be affected if the swimmer lifted his or her head entirely from the water to look forwardly.

FIG. 6 illustrates the substantial refraction that can occur with the preferred version of the goggles. Refraction occurs at both the planar top surface 92 where the light may be bent at 96 and also at the bottom, inner surface 94 where the light is bent in an upwards direction at 98. Accordingly, with goggles constructed in this manner, little, if any, upward movement of the head is required to view objects or persons approaching the swimmer in the horizontal direction.

The preferred material from which to make the top member 64 and the prism member 90 is optical plastic, ie. polycarbonate.

When the goggles 10 are intended for use by swimmers involved in races, the goggles are preferably made as aerodynamic as possible so as to reduce their drag effect through the water as much as possible. Accordingly, a more aerodynamic shape for the goggles than that illustrated in FIGS. 1 to 4 may be used without departing from the spirit and scope of this invention provided the swimmer is still able to view oncoming objects and swimmers through the transparent top members mounted in the goggles.

As will be readily apparent to those skilled in this art, various modifications and changes can be made to the goggles or face mask as described herein without departing from the spirit and scope of this invention. Accordingly, all such modifications as fall within the scope of the appended claims are intended to be part of this invention.

I claim:

1. Goggles for swimming comprising:

a frame portion including resilient flanges dimensioned to effect a water-tight seal with the face of a wearer;

two transparent face plates sealingly secured in said frame portion in order to cover the eyes of said wearer, said face plates extending in a first plane substantially perpendicular to a normal line of vision of the wearer; and two transparent top members secured in said frame portion above said face plates, each secured above a respective one of said face plates, and each having a planar top surface extending at a substantially acute angle ranging substantially between 20 and 90 degrees to said first plane, wherein the transparent top members are sufficiently large to permit the wearer to see through the top members;

wherein the wearer of said goggles is able to see horizontally through the transparent top members an object in front of the wearer while the wearer is swimming with the wearer's head facing generally downwardly in the water; and wherein the two top members are refracting prism members each having a planar top surface that extends at a small acute angle to a planar bottom surface of the respective prism member, the small acute angle being adjacent to the face plate and that the planar bottom surface extends at an angle of at least 90 degrees to the face plate.

2. Goggles for swimming according to claim 1 wherein said frame portion includes two frame sections, one section for each eye, and a bridge section adapted to extend over the wearer's nose and connecting said two frame sections together.

3. Goggles for swimming according to claim 2 wherein said bridge section is substantially rigid about a central axis extending through the center of said bridge section and generally perpendicular to said first plane.

4. Goggles according to claim 1 including a strap connected at opposite ends thereof to said frame portion, said strap being usable for securing said goggles to the wearer's head.

5. Goggles according to claim 1 including an anti-reflection coating covering said bottom surface of each top member.

6. Goggles for swimming comprising:

first and second frame sections each having a peripheral flange adapted to effect a water-tight seal with the face of a wearer, said two frame sections being flexibly connected to one another;

two transparent face plates each sealingly secured in a respective one of said frame sections and adapted to cover an eye of said wearer, said face plates extending in a plane substantially perpendicular to a normal line of vision of the wearer; and two transparent top members each sealingly secured in a respective one of said frame sections and having planar top and bottom surfaces, each of the top surfaces extending at a substantial angle not exceeding 90 degrees to the plane of said face plates, wherein the transparent top members are sufficiently large to permit the wearer to see through the top members, and wherein said top members are refracting prism members whose top surfaces each extend at a small acute angle to the bottom surface of the respective prism member and wherein the planar bottom surface extends at an angle of at least 90 degrees, and wherein, due to refraction of light passing through said top members, the wearer of said goggles is able to see horizontally through the top members an object in front of the wearer while the wearer is swimming with the wearer's head facing generally downwardly in the water.

7. Goggles according to claim 6 including a strap connected at opposite ends thereof to said frame portion, said strap being usable for securing said goggles to the wearer's head.

8. Goggles according to claim 6 including an anti-refection coating covering said bottom surface of each top member.

9. Mask for swimming comprising:

a frame portion dimensioned to effect a watertight seal with the face of a wearer and to extend around the eyes of the wearer;

a flat transparent front plate sealingly secured in said frame portion and positioned to extend in use over at least one eye of the wearer and in a first plane substantially perpendicular to a normal line of vision of the wearer;

a transparent top member sealingly secured in said frame portion above said front plate and having planar top and bottom surfaces, said top surface extending at a substantial angle ranging up to 90 degrees to said first plane, wherein said transparent top member is a prism whose top surface extends at a small acute angle to the bottom surface thereof, the small acute angle being adjacent to the flat plate and wherein the planar bottom surface extends at an angle of at least 90 degrees to the front plate and wherein the transparent top member is sufficiently large to permit the wearer to see through the top members, and wherein, during use of said mask in water, light striking said planar top surface is refracted at at least one of said top and bottom surfaces so as to enable the wearer to see horizontally through the transparent top member an object in front of the wearer while the wearer is swimming with the wearer's head facing generally downwardly in the water.

10. Mask for swimming according to claim 9 wherein said mask comprises goggles for covering both eyes of the wearer and there are two flat transparent front plates and two transparent top members sealingly secured in said frame portion.

11. The mask according to claim 9 including a strap connected at opposite ends thereof to said frame portion, said strap being usable for securing said goggles to the wearer's head.

12. The mask according to claim 9 including an anti-reflection coating covering said bottom surface of each top member.

* * * * *